US005328220A

United States Patent [19]

McPherson

[11] Patent Number: 5,328,220

[45] Date of Patent: Jul. 12, 1994

[54] BALL RETRIEVER

[76] Inventor: Bob D. McPherson, 15330 Mueck Rd., Needville, Tex. 77461

[21] Appl. No.: 29,716

[22] Filed: Mar. 11, 1993

[51] Int. Cl.[5] ..... A63B 47/02

[52] U.S. Cl. ..... 294/19.2; 273/32 F

[58] Field of Search ..... 294/19.1, 19.2; 273/32 B, 32 F, 162 E; 56/328.1, 332

[56] References Cited

U.S. PATENT DOCUMENTS

| | | | |
|---|---|---|---|
| 1,431,968 | 10/1922 | McDermott | 294/19.2 |
| 2,270,632 | 1/1942 | Hasty | 294/19.2 |
| 2,935,323 | 5/1960 | Cummings | 294/19.2 X |
| 3,046,044 | 7/1962 | Christle | 294/19.2 |
| 3,276,807 | 10/1966 | Ward | 294/19.2 X |
| 3,614,149 | 10/1971 | Clark | 294/19.2 |
| 4,180,288 | 12/1979 | Sievers | 294/19.2 |
| 4,322,939 | 4/1982 | McDonald | 294/19.2 X |
| 4,728,134 | 3/1988 | Allen | 294/19.2 |
| 4,968,079 | 11/1990 | Burton | 294/19.2 |

*Primary Examiner*—Dean J. Kramer
*Attorney, Agent, or Firm*—Rhodes & Ascolillo

[57] ABSTRACT

A ball retriever for retrieving a ball has a handle receiving member and at least two parallelly disposed ovoid ball barriers attached to the handle receiving member. At least one ball restraining member is attached to at least one ball barrier. At least two ball barrier support members connect the ball barriers. A ball receiving chamber, having a ball receiving port, is formed by the ball barriers and the ball restraining member. A handle lock mechanism, on the handle receiving member, releasably locks an extendible handle to the handle receiver.

2 Claims, 2 Drawing Sheets

BALL RETRIEVER

BACKGROUND OF THE INVENTION

1. Field of the Invention

This invention relates to a ball receiving device to retrieve balls and most especially golf balls when they are unintentionally deposited in difficult to reach environments such as underwater.

2. Description of the Related Art

Since the sport of golfing struck joy into the hearts of men, one sound has ruined a golfer's whole day. Splash! This ominous sound indicating to the golfer that the fates had been unkind and sent his ball to the watery depths. A number of mechanisms and methods have been developed to recover lost golf balls throughout the past. But none approach the ease of operation and portability of the present invention.

U.S. Pat. No. 4,180,288 to P. T. Sievers on Dec. 25, 1979 for a Golf Ball Retriever describes a retriever having a spring-loaded retainer and finger on a handle to releasingly engage a golf ball.

U.S. Pat. No. 4,728,134 to F. R. Allen on Mar. 1, 1988 for a Golf Ball Retriever shows an inverted cup mounted on a handle and having inwardly directed bails to retain a golf ball

SUMMARY OF THE INVENTION

Almost all golf courses have water hazards. Few things are more aggravating to a golfer than watching his or her ball rapidly sinking out of sight. At today's golf ball prices, losing the ball is more than annoying. It is costly. The present invention is an accessory that enables the golfer to retrieve a lost ball from a water hazard. The golfer immerses the retriever in the water. The handle may be extended to accommodate varying depths. The retriever is dragged along the bottom scooping up the errant balls through the ball receiving port and into the ball receiving chamber. More than one ball may be retrieved and the ball barriers and ball restraining bars keep the balls from rolling out of the chamber. The ball retriever is easily carried along with the golfer's other equipment since the handle collapses into itself and can be carried in a golf bag.

In a first alternative embodiment, a ball retriever for retrieving a ball has a handle receiving member and at least two ball barriers attached to the handle receiving member. There is at least one ball restraining member attached to at least one ball barrier and at least two ball barrier support members connecting the ball barriers. A ball receiving chamber, having a ball receiving port, is formed by the ball barriers and the ball restraining member.

In a second alternative embodiment, a ball retriever for retrieving a ball has a handle receiving member and at least two parallelly disposed ovoid ball barriers attached to the handle receiving member. At least one ball restraining member is attached to at least one ball barrier. There are at least two ball barrier support members connecting the ball barriers and a ball receiving chamber, having a ball receiving port, is formed by the ball barriers and the ball restraining member. There is a handle lock means on the handle receiving member.

It is an object of this invention is to provide a device to retrieve balls and particularly golf balls from underwater and from other difficult environments.

It is another object of this invention to provide a device to retrieve balls that is easily transportable to the location of the balls that need retrieved.

It is a further object of this invention to provide a device to retrieve and carry a plurality of balls prior to emptying the device of balls already gathered.

DESCRIPTION OF THE PREFERRED EMBODIMENT

Figure 1:
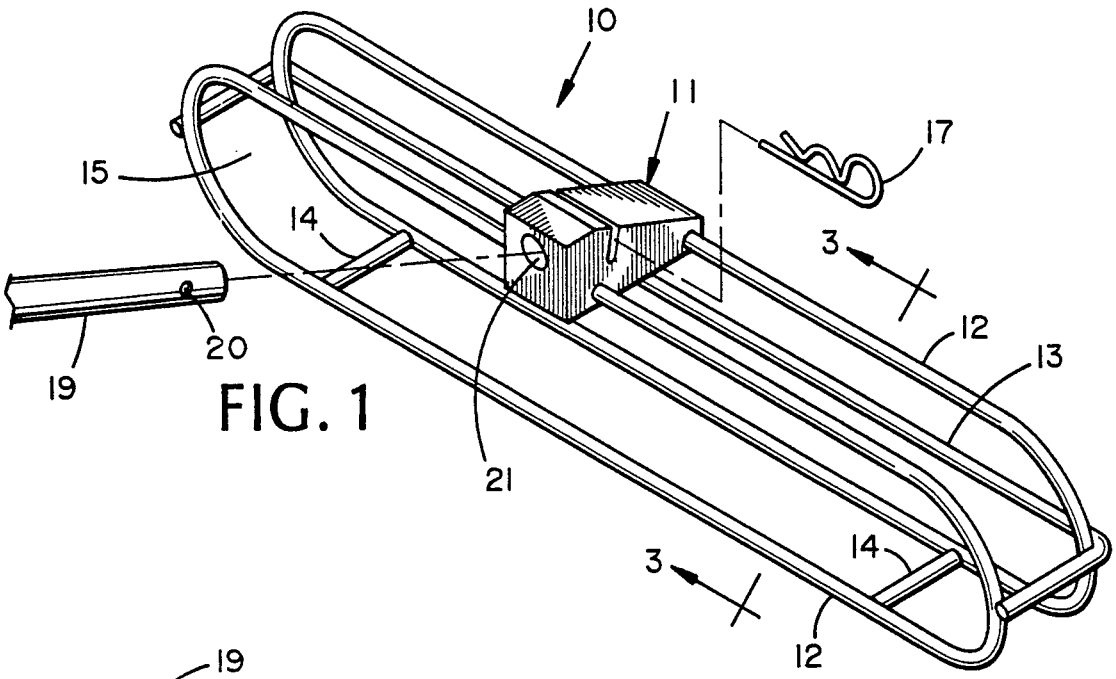
FIG. 1 is a perspective exploded front view of a ball retriever showing a handle and a handle locking means apart from the body of the ball retriever.
Figure 2:
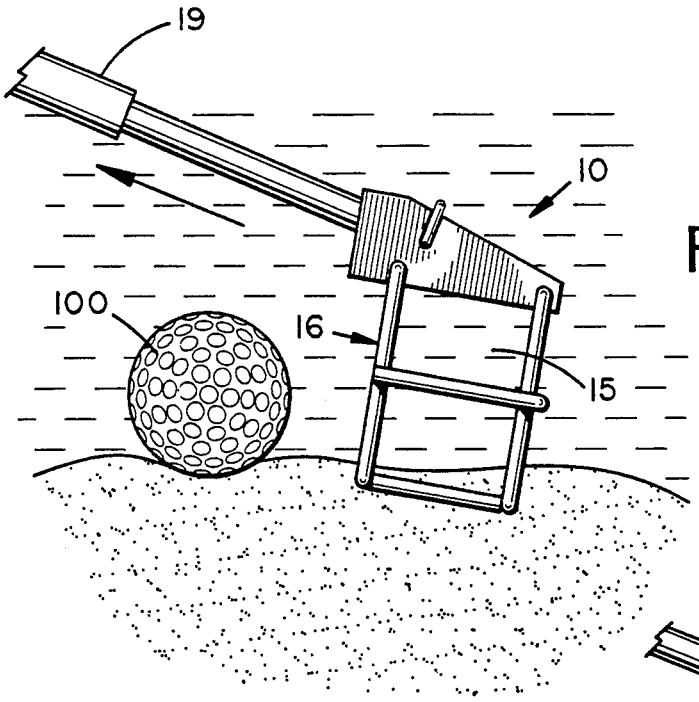
FIG. 2 is a partial side view of the ball retriever shown in use about to retrieve a ball from an underwater environment.
Figure 3:
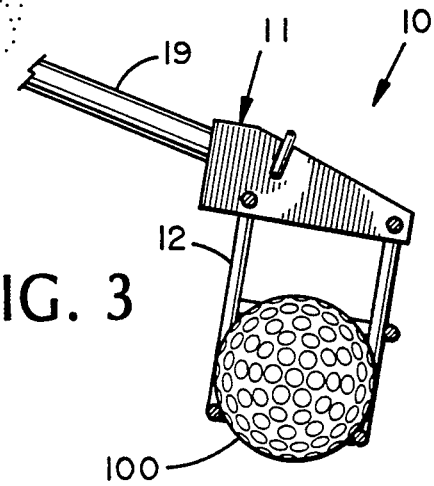
FIG. 3 is a partial cross-sectional side view along lines 3—3 of the ball retriever with a ball in the ball receiving chamber.
Figure 4:
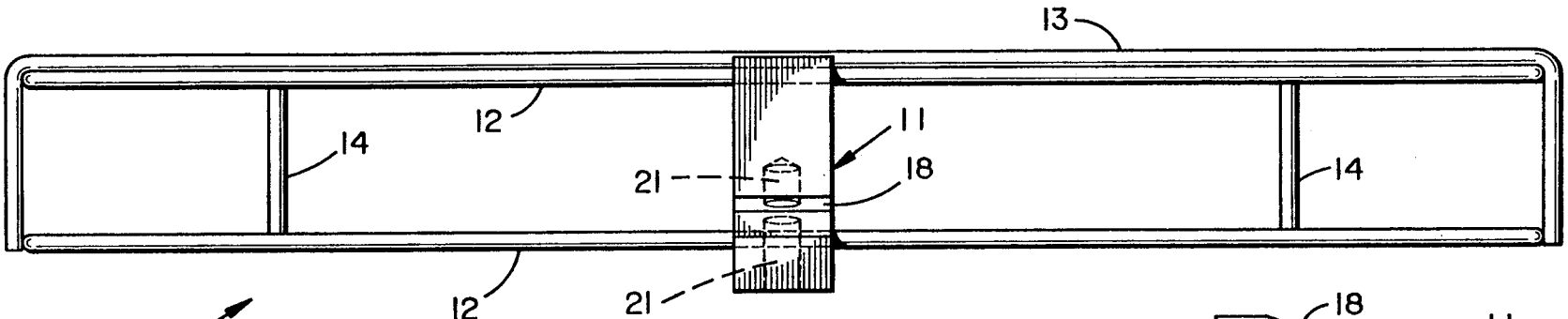
FIG. 4 is a top view.
Figure 6:
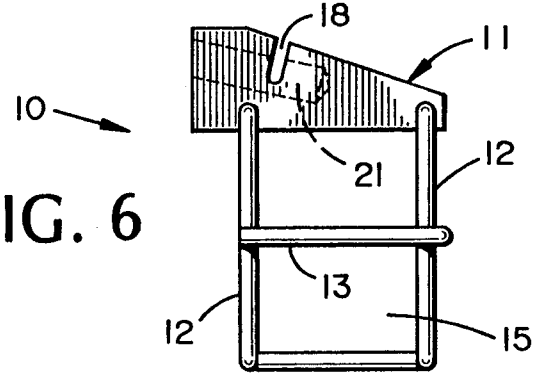
FIG. 6 is a right side view.
Figure 5:
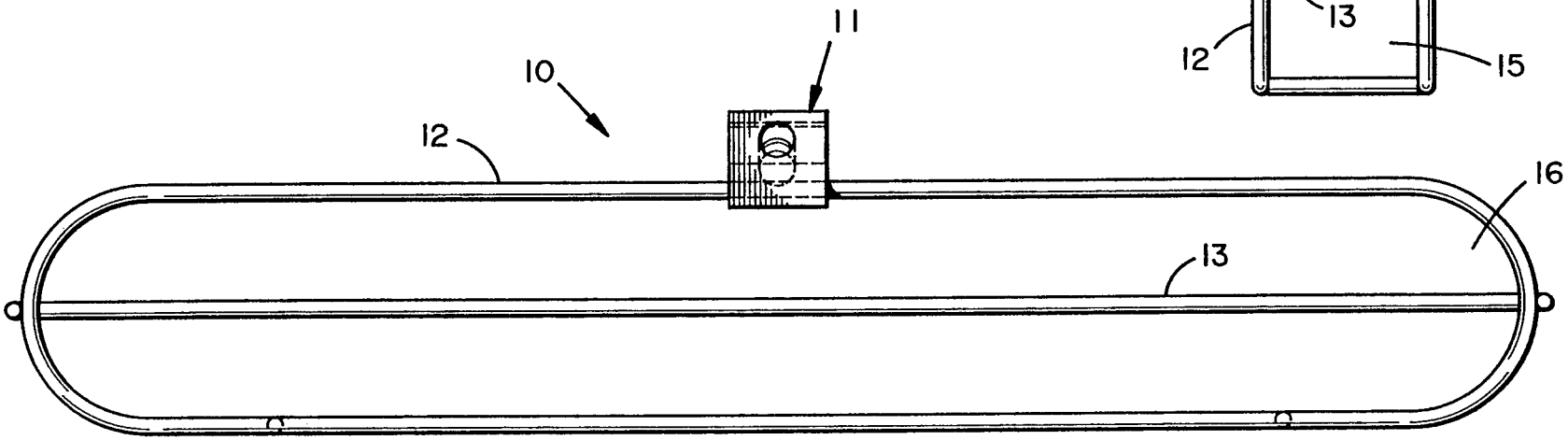
FIG. 5 is a front view.

Referring to FIGS. 1 through 6, a ball retriever 10 for retrieving a ball 100 is described that has a handle receiving member 11. There are at least two parallelly disposed ovoid ball barriers 12 attached to the handle receiving member 11 and at least one ball restraining member 13 attached to at least one ball barrier 12. At least two ball barrier support members 14 connect the ball barriers 12. A ball receiving chamber 15, having a ball receiving port 16, is formed by the ball barriers 12 and the ball restraining member 13. There is a handle lock means 17, on the handle receiving member 11 shown placed through pin groove 18 in the handle receiving member 11 and through pin port 20 in extendible handle 19. The handle lock means 17 releasably locks an extendible handle 19 to the handle receiving member 11. The handle receiving member has a handle receiving chamber 21 into which the handle 19 is placed.

The foregoing descriptions and drawings of the invention are explanatory and illustrative only, and various changes in shape, sizes and arrangements of parts as well certain details of the illustrated construction may be made within the scope of the appended claims without departing from the true spirit of the invention.

I claim:

1. A ball retriever for retrieving a ball comprising:

(a) a handle receiving member having a handle receiving bore capable of accepting one end of an extendible handle;

(b) at least two parallely disposed horizontally elongated substantially ellipsoidal ball barriers attached to the handle receiving member, each of said ball barriers being one continuous loop of substantially rigid material, the loop having oppositely arcuately curved ends, each of said ball barriers integrally extending through, and internally and fixedly intersecting with, said handle receiving member;

(c) at least one ball restraining member attached to at least one ball barrier, said restraining member having ends unconnected to each other;

(d) at least two ball barrier support members connecting the ball barriers;

(e) a ball receiving chamber, formed by the ball barriers, the barrier support members and the ball restraining member, said ball receiving chamber having an elongated ellipsoidal ball receiving port, encircled by a first ball barrier located nearest the handle, said first ball barrier forming the rim of said port; and (f) a handle lock means, having a pin groove on the handle receiving member cut perpendicularly to the longitudinal axis of the handle receiving bore and extending downward into the handle receiving member, said handle lock means also having a substantially U-shaped pin, one side of said pin slidingly and removably inserted along said pin groove and through a pin port in the extendible handle when said handle is fully inserted into the handle receiving bore, releasably locking the extendible handle to the handle receiver.

2. A ball retriever for retrieving a ball according to claim 1, wherein said restraining member and said ball barrier support members are formed from substantially rigid material.

* * * * *